US005311247A

United States Patent [19]

Hatori et al.

[11] Patent Number: 5,311,247

[45] Date of Patent: May 10, 1994

[54] PLATE MAKING MACHINE

[75] Inventors: Nobuyoshi Hatori; Toshio Koike, both of Tokyo, Japan

[73] Assignee: Iwatsu Electric Co., Ltd., Tokyo, Japan

[21] Appl. No.: 945,393

[22] Filed: Sep. 16, 1992

[30] Foreign Application Priority Data

Sep. 18, 1991 [JP] Japan ..... 3-267320

[51] Int. Cl.[5] ..... G03G 15/00

[52] U.S. Cl. ..... 355/43; 355/11; 355/97

[58] Field of Search ..... 355/85, 93, 97, 98, 355/99, 100, 101, 200, 239, 240, 241, 242, 43, 65

[56] References Cited

U.S. PATENT DOCUMENTS 3,843,251 10/1974 Washio ..... 355/13
3,876,300 4/1975 Washio ..... 355/12
4,616,920 10/1986 Itoigawa ..... 355/3 BE

*Primary Examiner*—Michael L. Gellner
*Assistant Examiner*—D. P. Malley
*Attorney, Agent, or Firm*—Oblon, Spivak, McClelland, Maier & Neustadt

[57] ABSTRACT

A plate making machine of a compact size has a mechanism for dealing with jamming, by which jammed master paper can be easily removed, and the maintenance of an exposure stage and a supply transfer system can be performed without disassembling the machine body. The supply transfer system for feeding the master paper X to the exposure stage 9 is provided in a generally horizontal direction at an upper portion of the plate making machine body 1. A lamp house 13 for projecting the original image is provided above the exposure stage 9. An exposure plate 24 is provided at the exposure stage 9, and the exposure plate is tiltable about tilting shaft 25 provided at the side thereof opposite to the supply transfer system. An endless feed belt 33 for feeding and discharging the master paper X relative to the exposure plate 24 is provided in surrounding relation to the exposure plate 24. A discharge transfer system is provided in a slanting manner below the supply transfer system, and the discharge transfer system takes up the master paper X, subjected to exposure, from the exposure plate 24 so as to develop and fix the latent image when the exposure plate 24 is in a tilted position.

9 Claims, 5 Drawing Sheets

PLATE MAKING MACHINE

BACKGROUND OF THE INVENTION

1. Field of the Invention

This invention relates to a plate making machine for making a printing master, and more particularly to a small-size plate making machine for making a small-size master such as one for a double postal card.

2. Description of the Related Art

As is well known, a plate making machine is used to produce an image master used in a printing machine. In a conventional plate making machine, a supply transfer system and a discharge transfer system (both of which transfer master paper) are provided respectively on opposite sides of an exposure stage (at which an original image is exposed) in adjacent relation to each other in a horizontal direction. After the master paper is electrostatically charged at the supply transfer system, the master paper is supplied to the exposure stage. Then, the master paper which has received a latent image of the original image at the exposure stage is fed to the discharge transfer system where the original image is made visible, and then the master paper is subjected to development and fixing, and then is fed to a discharge tray.

In the conventional plate making machine, since the supply transfer system and the discharge transfer system (both of which transfer the master paper) are thus provided respectively on the opposite sides of the exposure stage (at which the original image is exposed) in adjacent relation to each other in a horizontal direction, the size of the plate making machine in the horizontal direction tends to become large. Particularly in the field of light printing using a small-size master such as one for a double postal card, the space of installation of the plate making machine becomes large as compared with that of the printing machine, and therefore there has been a demand for a compact-size design of the plate making machine.

SUMMARY OF THE INVENTION

It is an object of this invention to provide a plate making machine which has a small-size and requires a small installation space in order to overcome the above dimensional problem of the conventional plate making machine.

The above object has been achieved by a plate making machine wherein cut master paper is statically charged, and is fed to an exposure stage where an original image is exposed on said master paper, and then this exposed latent image is developed and fixed. A supply transfer system for feeding said master paper to said exposure stage is provided in a generally horizontal direction at an upper portion of a body of the plate making machine. A lamp house for projecting the original image is provided above the exposure stage. An exposure plate is provided at the exposure stage, the exposure plate being tiltable about a tilting shaft provided at the side opposite to the supply transfer system. An endless feed belt for feeding and discharging the master paper relative to the exposure plate is provided in surrounding relation to said exposure plate. A discharge transfer system is provided in a slanting manner below said supply transfer system, the discharge transfer system taking up said master paper, subjected to exposure, from said exposure plate so as to develop and fix the latent image when the exposure plate is in a tilted position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

A preferred embodiment of the present invention will now be described in detail with reference to the drawings.

Figure 1:
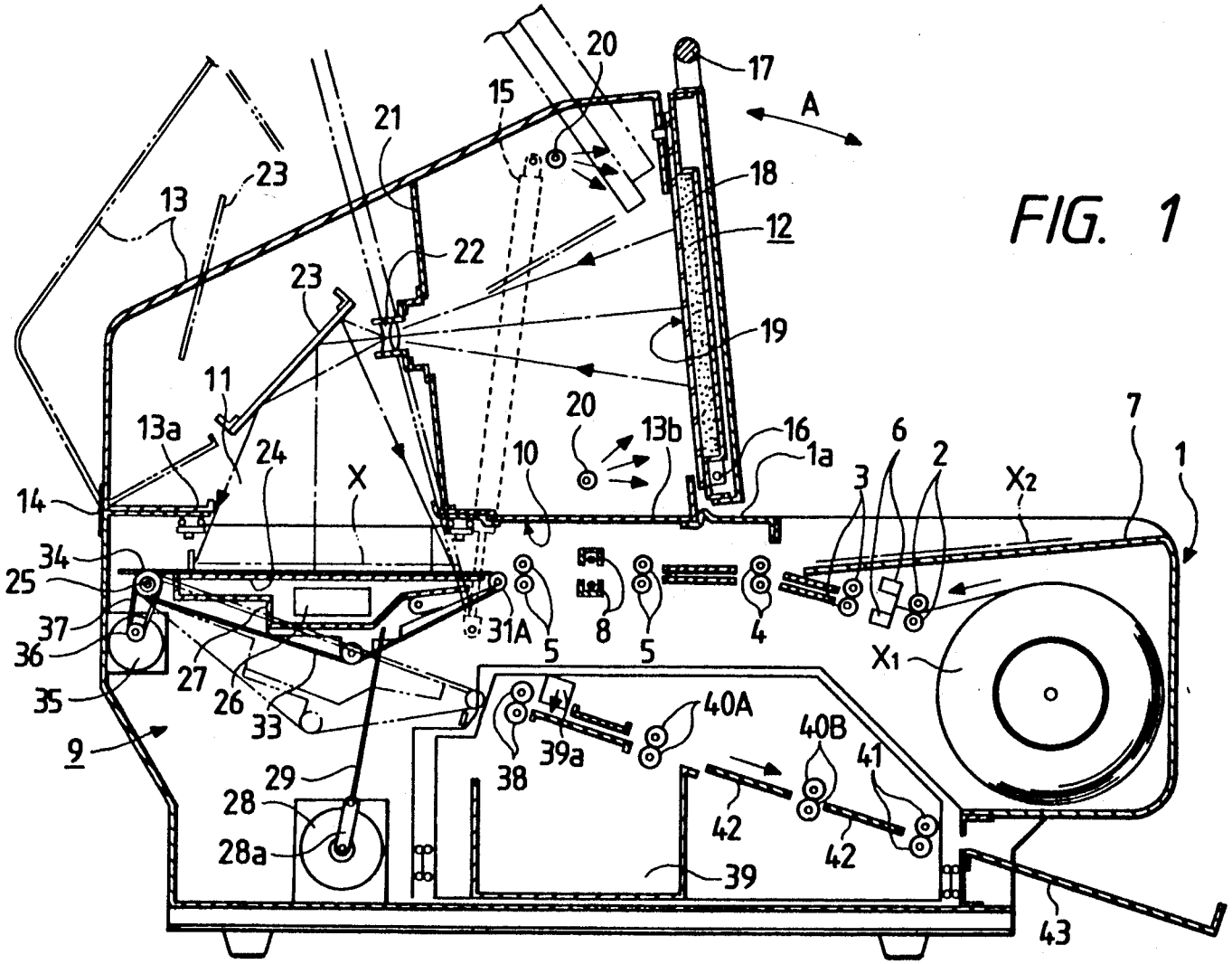
FIG. 1 is a cross-sectional view of an overall construction of a plate making machine according to the present invention.

FIG. 1 is a cross-sectional view of an overall construction of a plate making machine according to the present invention. A roll-like master $X_1$ wound around a bobbin is provided within a body 1 of the plate making machine, and is disposed at one side portion of this body. The roll-like master $X_1$ is provided at a supply transfer system which comprises take-up rollers 2, relay rollers 3, paper feed rollers 4 and two pairs of primary transfer rollers 5, all of which are disposed in a generally horizontal direction. More specifically, this supply transfer system comprises a cutter 6 between the take-up rollers 2 and the relay rollers 3, the cutter 6 cutting the roll-like master $X_1$ taken up by the take-up rollers 2 into a predetermined length. A manual paper feed plate 7 is provided above the roll-like master $X_1$, and slants downward toward the paper feed rollers 4. A cut master $X_2$ is supplied from this manual paper feed plate 7 to the paper feed rollers 4. Although not shown in the drawings, a master detector for detecting the master paper X is provided immediately before the paper feed rollers 4. When this master detector detects the cut master $X_2$, the rotation of the take-up rollers 2 is prevented, and therefore further feeding of the roll-like master $X_1$ is prohibited. A static charger 8 is provided between the two pairs of primary transfer rollers 5, and therefore the surface of the master paper X is statically charged while this master paper passes between these primary transfer rollers 5.

The master paper X thus statically charged is supplied to an exposure stage 9 which will be later described in detail with reference to FIGS. 2 to 7. A lamp house 13, having an original-supporting plate 12, is mounted on the upper side of the plate making machine body 1. The lamp house 13 is hingedly connected at its left end (FIG. 1) to the plate making machine body 1 by a lamp house hinge 14. When the lamp house 13 is located at a normal position (indicated in solid lines), only the exposure window 11 in the bottom plate 13*a* of the lamp house is opened. The lamp house 13 can be held in an opening position (indicated in phantom lines) by a gas spring 15 provided between the lamp house 13 and the plate making machine body 1, and the lamp house 13, when strongly pushed downward, is returned into the normal position (indicated in solid lines). When the lamp house 13 is held in an opening position, the entire lamp house bottom plate 13*a* also moves to an opening position to form a large operation hole 10 at this position for maintenance purposes.

The original-supporting plate 12 is hingedly connected at its lower portion to the front side of the lamp house 13 by a hinge 16. Namely, the original can be positioned between a pad 18 of the original-supporting plate 12 (which can be opened and closed in directions of arrow A through a handle 17) and a holder glass member 19. Mounted within the lamp house 13 are illumination lamps 20 for illuminating the original attached to the original-supporting plate 12, a projection lens 22 supported by a lens plate 21, and a reflection mirror 23. The image of the original projected by the projection lens 22 is formed on an exposure plate 24 of the exposure stage 9 by the reflection mirror 23.

Figure 5:
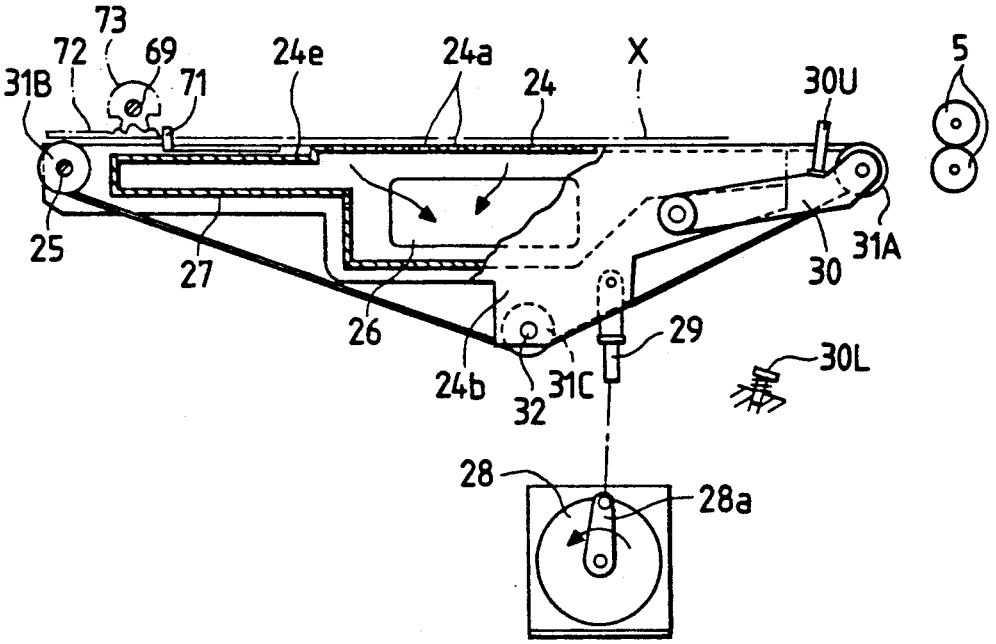
FIG. 5 is a partly-broken, enlarged side-elevational view of a portion of the plate making machine around an exposure plate.
Figure 6:
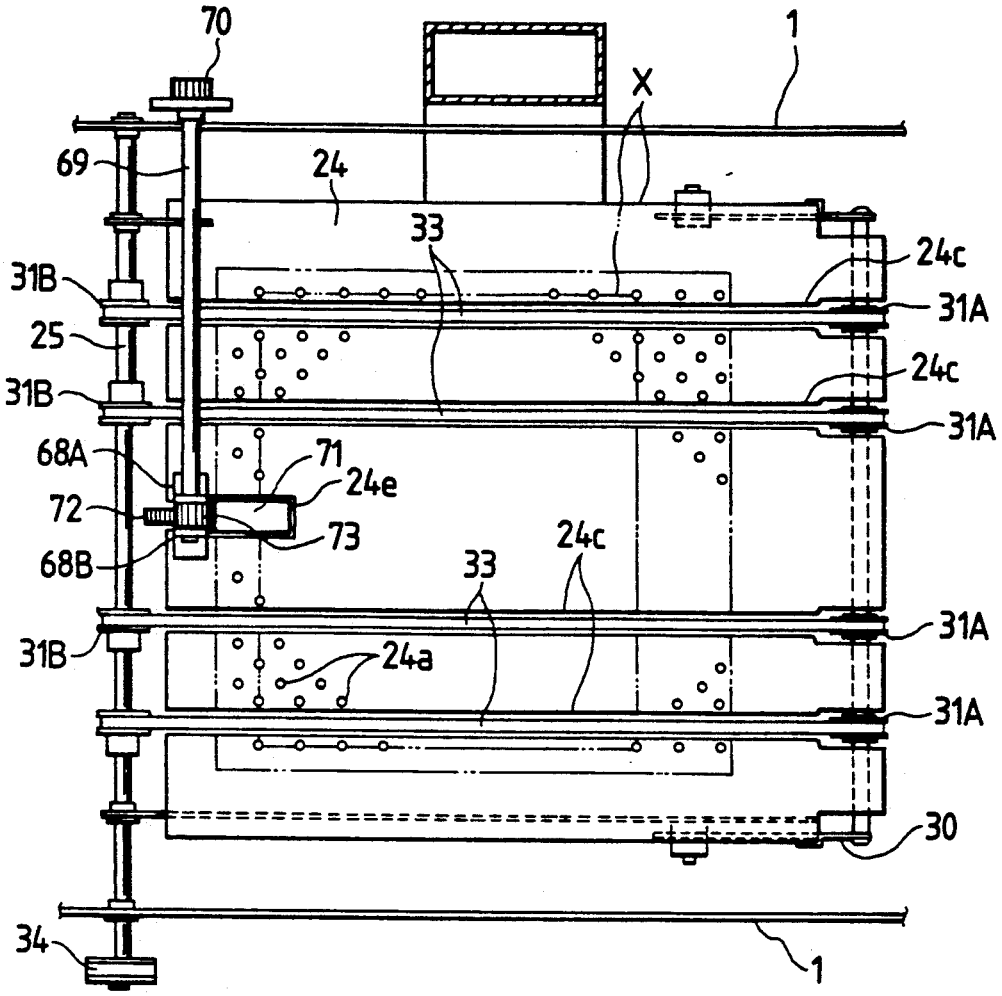
FIG. 6 is a plan view of the portion around the exposure plate.
Figure 7:
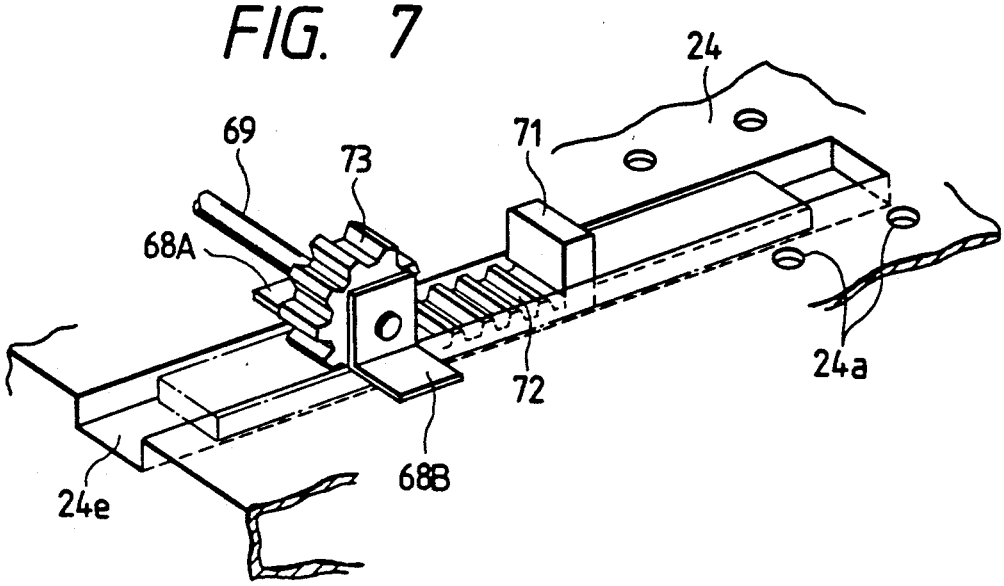
FIG. 7 is an enlarged perspective view of a master leading edge position adjustment mechanism of the plate making machine.
Figure 8A:
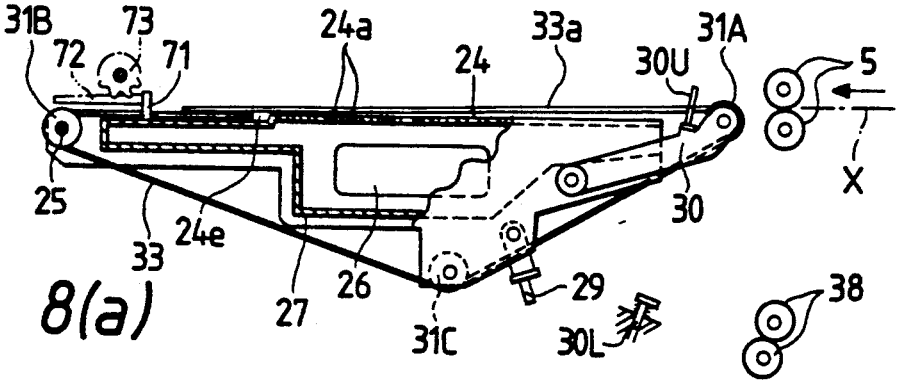
FIGS. 8(*a*) to 8(*d*) are views showing the operation around the exposure plate.
Figure 8B:
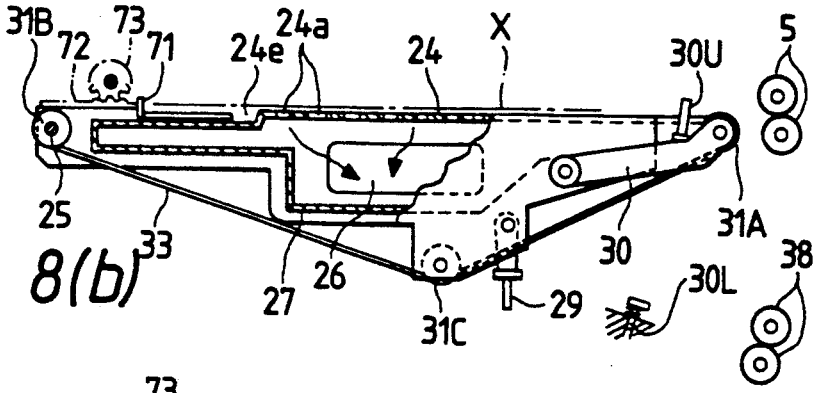
Figure 8C:
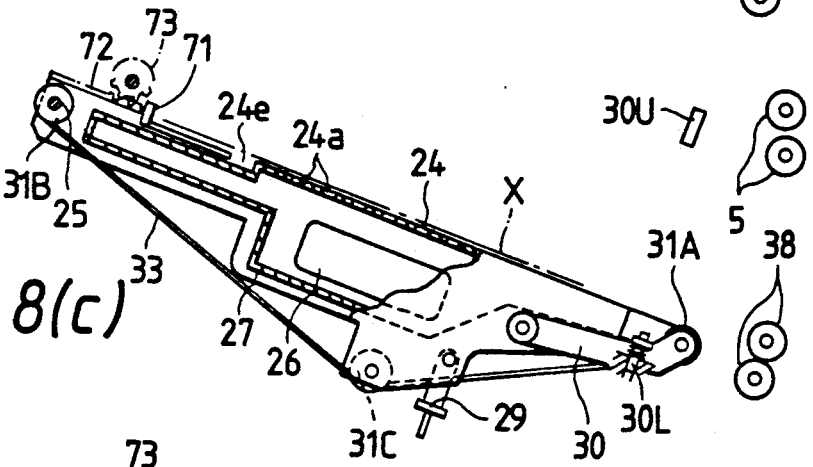
Figure 8D:
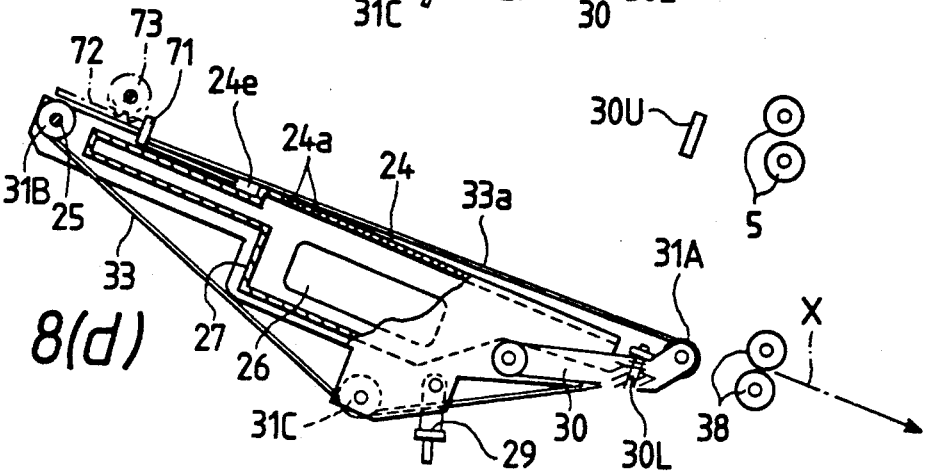

The exposure stage 9 includes the exposure plate 24 which is tiltably supported by a tilting shaft 25 at one end thereof remote from the primary transfer rollers 5. As shown in FIGS. 5 to 7, a vacuum box 27 for supplying a vacuum pressure from a vacuum hole 26 is fixedly mounted on the lower side of the exposure plate 24 having a number of suction holes 24*a* formed in its surface. A tilting rod 29, extended from a crank shaft 28*a* of a tilting motor 28 mounted within the plate making machine body 1, is connected to an intermediate portion of an exposure plate frame 24*b* of the exposure plate 24. Therefore, the exposure plate 24 and the exposure plate frame 24*b* can be reciprocally tiltably moved between an exposure position of FIG. 8(*b*) and a master discharge position of FIG. 8(*d*).

As shown in FIG. 6, a plurality of belt grooves 24*c* are formed in the surface of the exposure plate 24, and extend in the direction of feed of the master paper X. A plurality of endless feed belts 33 are disposed respectively in the belt grooves 24*c*, and are extended around movable pulleys 31A, supported by a shaft mounted on pivotal arms 30 pivotally connected at their ends to the exposure plate frame 24*b*, pulleys 31B fixedly mounted on the tilting shaft 25, and pulleys 31C mounted on a pulley shaft 32 on the exposure plate frames 24*b*. As shown in FIG. 6, a driven pulley 34 is fixedly mounted on the end of the tilting shaft 25, and this driven pulley 34 is driven in a normal direction (left direction in FIG. 1) and a reverse direction by a drive belt 37 extended around the driven pulley 34 and a drive pulley 36 connected to a belt drive motor 35.

Provided in the path of movement of the exposure plate frame 24*b* are an upper limit stopper 30U and a lower limit stopper 30L which can be contacted with the pivotal arms 30 in the exposure position and in the master discharge position.

Referring back to FIG. 1, the master paper X subjected to exposure is fed to secondary transfer rollers 38 of the discharge transfer system from the exposure plate 24 disposed in the master discharge position (chain lines in FIG. 1). Namely, the discharge transfer system, slanting downward below the above-mentioned supply transfer system, includes a rinse-squeeze device 39, and the static latent image on the master paper X is developed while this master paper moves past a developer spray 39*a*. The discharge transfer system also includes two pairs of relay rollers 40A and 40B and discharge rollers 41 which are provided next to the rinse-squeeze device 39. The original image on the surface of the master paper X is fixed by panel heaters 42 provided between these rollers 40A, 40B and 41, and the master paper X is discharged by the rotational feed of the discharge rollers 41 to a paper discharge tray 43 provided exteriorly of the plate making machine body 1.

Figure 2:
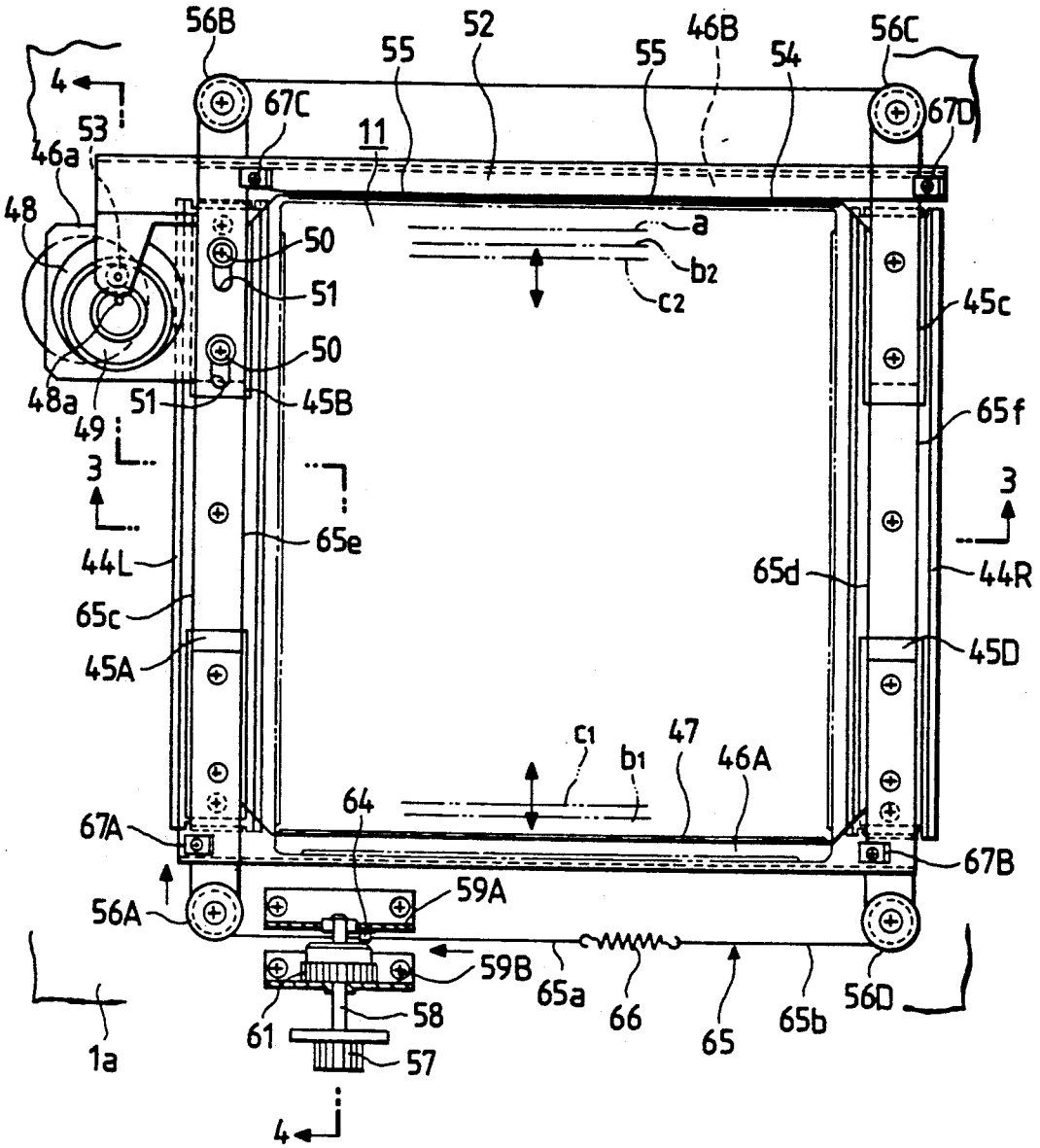
FIG. 2 is a bottom view of a master width regulating device of the plate making machine.
Figure 3:
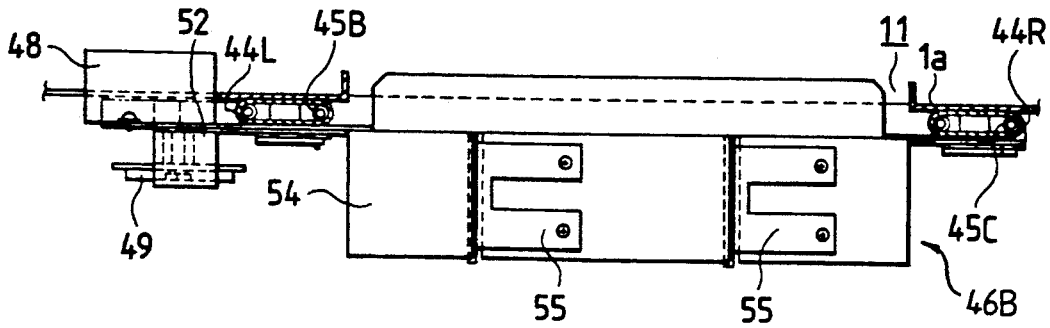
FIG. 3 is a cross-sectional view taken along the line 3—3 of FIG. 2.
Figure 4:
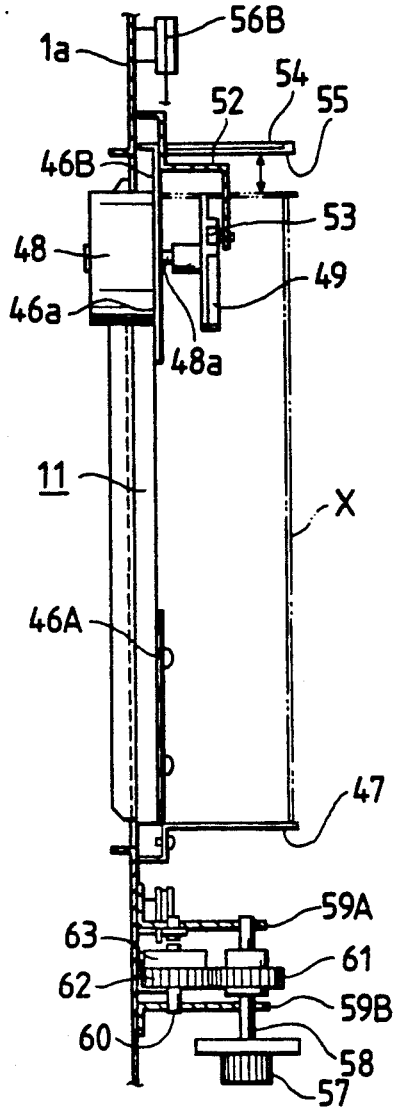
FIG. 4 is a cross-sectional view taken along the line 4—4 of FIG. 2.

FIGS. 2 to 4 show a master width regulating device mounted on the lower surface of the top plate 1*a* in surrounding relation to the exposure window 11. The master width regulating device includes a pair of guide rails 44L and 44R which extend in a direction (in the direction of the width of the master paper X) perpendicular to the direction of feed of the master paper X, and are provided respectively at the front and rear sides of the exposure window 11. Four sliders 45A, 45B, 45C and 45D are slidably supported adjacent to the ends of the guide rails 44L and 44R so as to slide along the mating guide rails 44L and 44R, respectively. A pair of U-shaped connecting members 46A and 46B are fixedly secured at their opposite (front and rear) ends to the pairs of mating sliders (the pair of sliders 45A and 45D and the pair of sliders 45B and 45C) opposed to each other in the direction of feed of the master paper X. A fixed-side limitation plate 47 is fixedly secured to the lower surface of the U-shaped connecting member 46A, and depends therefrom toward the exposure plate 24.

A motor mounting portion 46*a* is formed integrally on one end of the U-shaped connecting member 46B interconnecting the sliders 45B and 45C, and a reciprocal motor 48 having a drive shaft 48*a* having a groove cam 49 is fixedly mounted on the motor mounting portion 46*a*. A cam follower 53 of a reciprocal member 52 is engaged in the groove cam 49, the reciprocal member 52 having slots 51 in which a pair of guide pins 50 formed on the lower surface of the U-shaped connecting member 46B are received. A movable-side limitation plate 54 is fixedly mounted on the reciprocal member 52 reciprocally movable in the direction of the width of the master paper X, this limitation plate 54 depending toward the exposure plate 24 in opposed relation to the fixed-side limitation plate 47. A pair of leaf springs 55 are fixedly mounted at their one ends in a cantilever manner on the surface of the movable-side limitation plate 54 disposed in opposed relation to the fixed-side limitation plate 47. Therefore, as later described, when the movable-side limitation plate 54 is reciprocally moved, these leaf springs 55 can be resiliently contacted with the corresponding side edge of the master paper X on the exposure plate 24.

On the other hand, as shown in FIGS. 2 and 4, four sheaves 56A, 56B, 56C and 56D are rotatably mounted on the lower surface of the top plate 1*a* of the plate making machine body 1, these sheaves being disposed on lines of extension of the guide rails 44L and 44R. A pair of L-shaped brackets 59A and 59B, supporting an adjustment shaft 58 having a width set thumbpiece 57, are arranged on the lower surface of the top plate 1*a* intermediate the sheaves 56A and 56D. As shown in FIG. 4, a wire shaft 60 is supported on the L-shaped brackets 59A and 59B in parallel relation to the adjustment shaft 58. A speed reduction gear 62 (which is in mesh with a wire drive gear 61 fixedly mounted on the adjustment shaft 58) and a click disk 63 molded integrally with the speed reduction gear 62 are fixedly mounted on the wire shaft 60. A click 64 (shown in FIG. 2) is fixed to the L-shaped bracket 59A, and is disposed in a path of movement of a plurality of half-fixed holes (not shown) formed in the click disk 63.

A wire 65 for driving the fixed-side limitation plate 47 and the movable-side limitation plate 54 in opposite directions is extended in tension around the sheaves 56A, 56B, 56C and 56D and the wire shaft 60. Namely, one end portion 65*a* of the wire 65 is wound around the wire shaft 60, and then is extended sequentially around the sheave 56A, the sheave 56B, the sheave 56A, the sheave 56B, the sheave 56C, the sheave 56D, the sheave 56C and the sheave 56D. The other end portion 65*b* of the wire 65 is extended from the sheave 56D, and is connected in an endless manner to the end portion 65*a* via a tension spring 66. That portion 65*c* of the wire 65 extending from the sheave 56A to the sheave 56B and that portion 65*d* of the wire 65 extending from the sheave 56D to the sheave 56C are fixed to the U-shaped connecting member 46A by respective stays 67A and 67B. That portion 65*e* of the wire 65 extending from the sheave 56B to the sheave 56A and that portion 65*f* of the wire 65 extending from the sheave 56C to the sheave 56D are fixed to the U-shaped connecting member 46B by respective stays 67C and 67D. Therefore, when the wire 65 is driven in a clockwise direction in FIG. 2, the fixed-side limitation plate 47 and the movable-side limitation plate 54 are driven to move toward each other. When the wire 65 is driven in a counterclockwise direction in FIG. 2, the fixed-side limitation plate 47 and the movable-side limitation plate 54 are driven to move away from each other in the direction of the width of the master paper X.

As shown in FIGS. 6 and 7, a master leading edge position adjustment mechanism for limiting the position of the leading edge of the master paper X to be exposed is provided at one end of the exposure plate 24. Namely, a pair of mounting brackets 68A and 68B are fixedly mounted on the surface of one end portion of the exposure plate 24, and an adjustment shaft 69 extending in the direction of the width of the master paper X is rotatably supported by the mounting brackets 68A and 68B. A leading edge position adjustment thumbpiece 70 which can be manually operated is fixedly mounted on the adjustment shaft 69. Provided between the opposed mounting brackets 68A and 68B is a stopper groove 24*e* extending in the direction of feed of the master paper X (that is, in the direction of the length of the master paper X). A rack 72 is slidably received in the stopper groove 24*e*, and a master stopper 71 for abutting against the leading edge of the master paper X is mounted on one end of the rack 72. The rack 72 is in mesh with a pinion 73 fixedly mounted on the adjustment shaft 69. Therefore, when the leading edge position adjustment thumbpiece 70 is angularly moved, the rack 72 and the master stopper 71 are moved in the direction of the length of the master paper X by the pinion 73 angularly moved by the adjustment shaft 69. As a result, the position of stop of the master paper X on the exposure plate 24 is changed, so that the position of exposure of the original image relative to the master paper X can be adjusted.

The late making machine of the illustrated embodiment has the above construction, and therefore the exposure and development of the original image with respect to the roll-like master $X_1$ or the cut master $X_2$ are effected through the following steps.

In the stand-by condition of the plate making machine, the tilting rod 29 of the tilting motor 28 is disposed immediately before the upper dead center position, and the exposure plate 24 and the endless feed belts 33 are disposed in the condition shown in FIG. 8(*a*). Namely, since the upper limit stopper 30U is engaged with the pivotal arm 30, an upper side portion 33*a* of each endless feed belt 33 is disposed in registry with the primary transfer rollers 5 and the paper feed rollers 4, and the exposure plate 24 is disposed slightly slant to the horizontal condition. Therefore, when the cut master $X_2$ or the roll-like master $X_1$ is supplied to the paper feed rollers 4 after the original is attached to the original-supporting plate 12, the belt drive motor 35 is rotated in the normal direction. As a result, this master paper X is statically charged while it passes the static charger 8, and the master paper X is fed onto the exposure plate 24 by the primary transfer rollers 5 and the endless feed belts 33 which are rotated in their normal directions. The master paper is then abutted against and stopped by the master stopper 71.

When the master paper X is detected, the belt drive motor 35 is stopped, and the reciprocal motor is driven for a predetermined period of time. Therefore, the cam follower 53 integral with the reciprocal member 52 is reciprocally moved in the direction of the width of the master paper X by the groove cam 49 of the reciprocal motor, so that the movable-side limitation plate 54 fixedly mounted on the reciprocal member 52 is reciprocally moved. As a result, the leaf springs 55 on the movable-side limitation plate 54 are resiliently contacted with the corresponding side of the master paper X, so that the master paper X on the upper side portions 33*a* of the endless feed belts 33 is caused to be disposed along the fixed-side limitation plate 47, thereby determining the position of the master paper X in its widthwise direction.

With the above steps, the positioning of the leading edge of the master paper X, as well as the positioning of the master paper in its widthwise direction, is finished, and the tilting motor 28 is again rotated in the normal direction to angularly move the tilting rod 29 to the upper dead center position. In this case, since the upper limit stopper 30U is already held against the pivotal arm 30, the upper side portions 33*a* of the endless feed belts 33 will not further ascend; however, as shown in FIG. 8(*b*), the exposure plate 24 and the vacuum box 27 ascend, with pivoting of pivotal arms 30, and the master paper X on the upper side portions 33*a* of the endless feed belts 33 is drawn to the surface of the exposure plate 24 by the vacuum pressure of the vacuum box 27, so that the flatness of the master paper X is maintained.

After this step, the illumination lamp is turned on, the original image is projected onto the surface of the master paper X by the projection lens 22, and the master paper X is subjected to exposure. After the exposure is finished, the tilting rod 29 is angularly moved by the tilting motor 28 to the position shown in FIG. 8(*c*). Namely, when the exposure plate 24 and the vacuum box 27 reach the position shown in FIG. 8(*c*), the pivotal arms 30 are engaged with the lower limit stopper 30L, and the upper side portions 33*a* of the endless feed belts 33 are disposed in line with the secondary transfer rollers 38. Then, when the tilting rod 29 is angularly moved to the lower dead center shown in FIG. 8(*d*), the exposure plate 24 and the vacuum box 27 are further angularly moved, with pivoting of the pivotal arms 30, whereas the position of the upper side portions 33*a* of the endless feed belts 33 is not changed because of the stopping operation by the lower limit stopper 30L, so that the exposure plate 24 is separated from the master paper X on the upper side portions 33*a* of the endless feed belts 33.

Then, the belt drive motor 35 is rotated in the reverse direction, so that the master paper X is taken up by the secondary transfer rollers 38, and the electrostatic latent image on the surface of the master paper X is developed while the master paper X passes the rinse-squeeze device 39, and this image is fixed by heating effected by the panel heaters 42, and the master paper X is discharged to the paper discharge tray 43.

When the discharge of the master paper X is detected, the tilting motor 28 is again activated, and the endless feed belts 33 and the exposure plate 24 are returned to the condition shown in FIG. 8(*a*), and stand by in this condition.

In the manufacture of the printing master, for adjusting the exposure position of the master paper X in its longitudinal direction, it is only necessary to manually operate the leading edge position adjustment thumbpiece 70. Namely, when the leading edge position adjustment thumbpiece 70 is manually operated, the rack 72 and the master stopper 71 are slidingly moved in the direction of the length of the master paper X by the pinion 73 on the adjustment shaft 69 on which the leading edge position adjustment thumbpiece 70 is fixedly mounted. Therefore, the original image can be exposed on the surface of the master paper X in accordance with the image position of the light printing machine in which the master is used.

In the manufacture of the printing master, for adjusting the position of the fixed-side limitation plate 47 in according with the size of the master paper X, the width set thumbpiece 57 is manually operated. Namely, when the fixed-side limitation plate 47 is disposed in the position indicated by a solid line in FIG. 2, the movable-side limitation plate 54 is also disposed in the position indicated in a solid line, and the movable-side limitation plate 54 is reciprocally moved by the reciprocal motor to a position indicated by an imaginary line a. Also, by manually operating the width set thumbpiece 57, the fixed-side limitation plate 47 is disposed in a half-fixed manner in a position indicated by an imaginary line b1 in FIG. 2 or in a position indicated by an imaginary line c1, and in this case the movable-side limitation plate 54 is reciprocally moved to a position indicated by an imaginary line b2 in FIG. 2 or a position indicated by an imaginary line c2. In other words, by manually adjusting the width set thumbpiece 57, the spacing between the fixed-side limitation plate 47 and the movable-side limitation plate 54 is changed, so that a suitable relation between the fixed-side limitation plate 47 and the movable-side limitation plate can be obtained depending on the size of the master paper X to be exposed (i.e., the size in the direction of the width of the master paper X).

When the master paper X is jammed within the plate making machine body 1, or when the maintenance of the interior of the machine is to be effected, the lamp house 13 is lifted. In this case, the lamp house 13 is moved about the lamp house hinge 14 into the open condition as indicated in phantom in FIG. 1, and this condition is maintained by the gas stay 15. When the lamp house 13 is thus opened, the operation hole 10 and the exposure window 11 of the plate making machine body 1 are open to the exterior. Therefore, the jammed master paper X which is seen through the operation hole 10 and the exposure window 11 can be removed, and besides the paper feed rollers 4, the static charger 8 and the primary transfer rollers 5 corresponding to the operation hole 10 can be serviced, and the constituents of the exposure stage 9 corresponding to the exposure window 11 can be serviced.

As is clear from the above description, in the present invention, the tiltable exposure plate is provided at one end of the supply transfer system provided at the upper portion of the plate making machine body. After the exposure of the master paper is effected on the exposure plate, the master paper is developed and fixed at the discharge transfer system, provided below the supply transfer system, through the endless feed belts associated with the exposure plate. Therefore, the small-size plate making machine requiring a small installation space can be obtained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A plate making machine comprising:

a plate making machine body;

an original image exposure stage in the machine body, the original image exposure stage including means for exposing an original image on a master paper in the original image exposure stage;

a supply transfer system for feeding the master paper to said exposure stage, and extending in a generally horizontal direction at an upper portion of the machine body;

a lamp housing for projecting the original image and provided above said exposure stage;

an exposure plate provided at said exposure stage, said exposure plate being tiltable about an axis provided at a side of the exposure plate opposite to said supply transfer system;

an endless feed belt for feeding and discharging the master paper relative to said exposure plate and provided in surrounding relation to said exposure plate; and a discharge transfer system extending in a slanting manner below said supply transfer system, said discharge transfer system having means for taking up the exposed master paper from the tilted exposure plate and means for developing and fixing a latent image on the exposed master paper.

2. The plate making machine of claim 1 including means for moving said exposure plate between an exposure position and a tilted position.

3. The plate making machine of claim 2 wherein said endless feed belt is mounted on a pivotal arm which pivots relative to said exposure plate, including upper and lower stop means for limiting the tilting of said pivotal arm such that said endless feed belt aligns with said supply and discharge transfer systems when said exposure plate is moved to said exposure position and said tilted position, respectively.

4. The plate making machine of claim 3 wherein said moving means comprises means for moving said exposure plate beyond limits imposed by said upper and lower stop means, whereby said pivot arm is pivoted to separate the endless belt from said exposure plate when said exposure plate is moved to said exposure position and said tilted position.

5. The plate making machine of claim 4 including suction means in said exposure plate for holding a master on said exposure plate.

6. The plate making machine of claim 1 including master width regulating means mounted on said exposure plate.

7. The plate making machine of claim 1 including master leading edge position adjustment means mounted on said exposure plate.

8. The plate making machine of claim 1 wherein said lamp housing is mounted to said machine body for movement to an open position where the exposure stage is accessible for servicing from outside of the machine body.

9. The plate making machine of claim 8 wherein said lamp housing is pivoted to said machine body and covers an opening of the machine body when the lamp housing is in a closed position.

* * * * *